US006213807B1

(12) United States Patent
Huang et al.

(10) Patent No.: US 6,213,807 B1
(45) Date of Patent: Apr. 10, 2001

(54) ZIF SOCKET CONNECTOR HAVING IMPROVED CONTACT ARRANGEMENT

(75) Inventors: Yao-Chi Huang, Yung-Ho; Shih-Wei Hsiao, Kaohsung, both of (TW)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 09/369,773

(22) Filed: Aug. 6, 1999

(30) Foreign Application Priority Data

Feb. 2, 1999 (TW) ..... 88201717

(51) Int. Cl.[7] ..... H01R 13/625
(52) U.S. Cl. ..... 439/342
(58) Field of Search ..... 439/342, 259–270

(56) References Cited

U.S. PATENT DOCUMENTS 5,044,973 * 9/1991 Noda et al. ..... 439/342
5,092,789 * 3/1992 Sinclair ..... 439/342
5,535,513 * 7/1996 Frantz ..... 439/83
5,658,160 * 8/1997 Lai ..... 439/342
5,746,608 * 5/1998 Taylor ..... 439/83
5,797,774 * 8/1998 Kaneko ..... 439/342

* cited by examiner

*Primary Examiner*—Gary Paumen
(74) *Attorney, Agent, or Firm*—Wei Te Chung

(57) ABSTRACT

A contact for a ZIF socket for electrically connecting with a pin of a chipset comprises a base portion, a connecting portion extending from the base portion, and a body portion extending from one side of the connecting portion. The body portion includes a receiving portion adapted for receiving the pin of the chipset to be in a first position, and a mating portion extending from the receiving portion for sidewardly gripping the pin of the chipset when the pin is moved from the first position to a second position. The base portion has a pair of fixing protrusions on opposite edges thereof for interferentially engaging with a housing. An interferential direction between the fixing protrusions and the housing is substantially perpendicular to a movement direction of the pin from the first portion to the second portion.

3 Claims, 6 Drawing Sheets

ZIF SOCKET CONNECTOR HAVING IMPROVED CONTACT ARRANGEMENT

BACKGROUND OF THE INVENTION

1. Field of the Invention

The present invention relates to a contact for a socket, and particularly to a contact for a ZIF socket.

2. Description of Prior Art

Referring to FIG. 1, a contact 6 for a ZIF socket generally comprises a base portion 61, a connecting portion 62 connected to the base portion 61 and a body portion 63 extending from the connecting portion 62. The base portion 61 forms a pair of fixing protrusions 611 on opposite edges thereof for being interferentially received in a housing 8 (see FIG. 3) whereby the base portions 61 are linearly aligned. The body portion 63 is U-shaped and forms a receiving portion 631 extending from the connecting portion 62 for receiving a pin 7 of a chipset (not shown) and a mating tail 632 extending from the receiving potion 631 for engaging with the pin 7.

However, as shown in FIG. 2, when the pin 7 is moved to engage with the mating tail 632 of the contact 6 from the receiving portion 631, a force f caused by resisting the movement of the pin 7 is exerted on the contact 6. Thus, an accompanying moment for the force f is created but does not act on the center of mass of the contact 6. Since the body portion 63 is U-shaped, a normal force from the mating tail 632 being exerted on the pin 7 is insufficient to maintain a stable contact resistance. Furthermore, the U-shaped body portion 63 does not promote the implementation of zero insertion force. Additionally, the linear alignment of interference between the base portions 61 of the contacts 6 and the housing 8 causes deformation of the housing.

SUMMARY OF THE INVENTION

Accordingly, an object of the present invention is to provide a contact for a ZIF socket having a pair of fixing protrusions lying in a plane which is substantially perpendicular to the direction of the movement of a pin of a chipset thereby preventing unwanted moment to the contact.

Another object of the present invention is to provide a contact for a ZIF socket having a simplified body portion while generating sufficient normal force between the contact engaged with the pin to maintain a stable contact resistance and promoting the implementation of zero insertion force.

Yet another object of the present invention is to provide a housing having contacts interferentially engaged therewith wherein the engagement force between adjacent rows of the contacts is not linearly aligned for thereby reducing deformation of the housing.

In order to achieve the objects set forth, a contact for a ZIF socket for electrically connecting with a pin of a chipset in accordance with the present invention, comprises a base portion, a connecting portion extending from the base portion, and a body portion extending from one side of the connecting portion. The body portion includes a receiving portion adapted for receiving the pin of the chipset located in a first position, and a mating portion extending from the receiving portion for sidewardly gripping the pin of the chipset when the pin is moved from the first position to a second position. The base portion has a pair of fixing protrusions on opposite edges thereof for interferentially engaging with a housing. An interferential direction between the fixing protrusions and the housing is substantially perpendicular to a movement direction of the pin from the first portion to the second portion.

BRIEF DESCRIPTION OF THE DRAWINGS

Other objects and advantages of the present invention will be understood from the following description of an electrical connector according to a preferred embodiment of the present invention shown in the accompanying drawings, in which.

DETAILED DESCRIPTION OF THE PREFERRED EMBODIMENT

Figure 1:
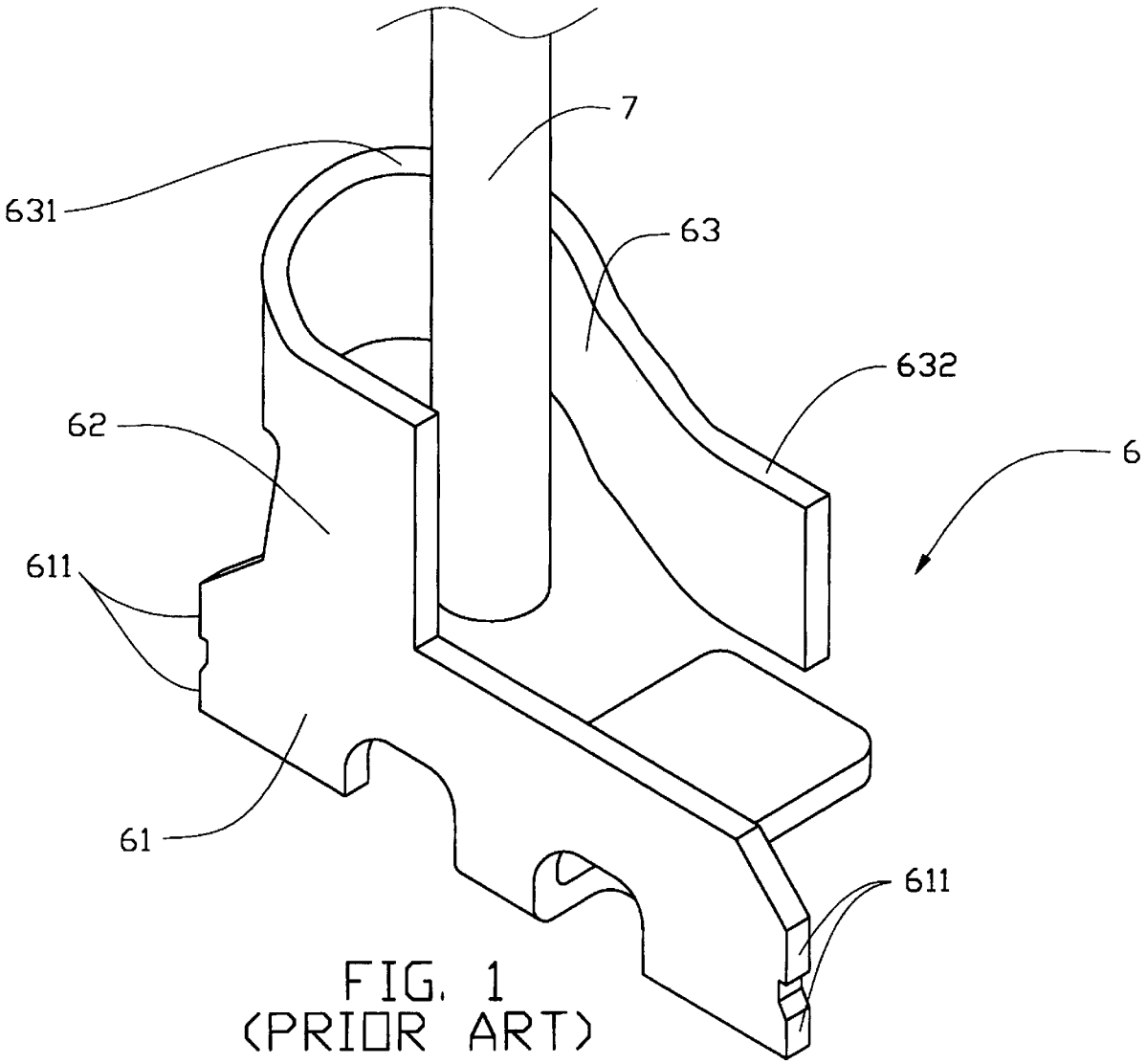
FIG. 1 (PRIOR ART)
FIG. 1 is a perspective view of a conventional contact for a ZIF socket including a pin of a chipset.
Figure 2:
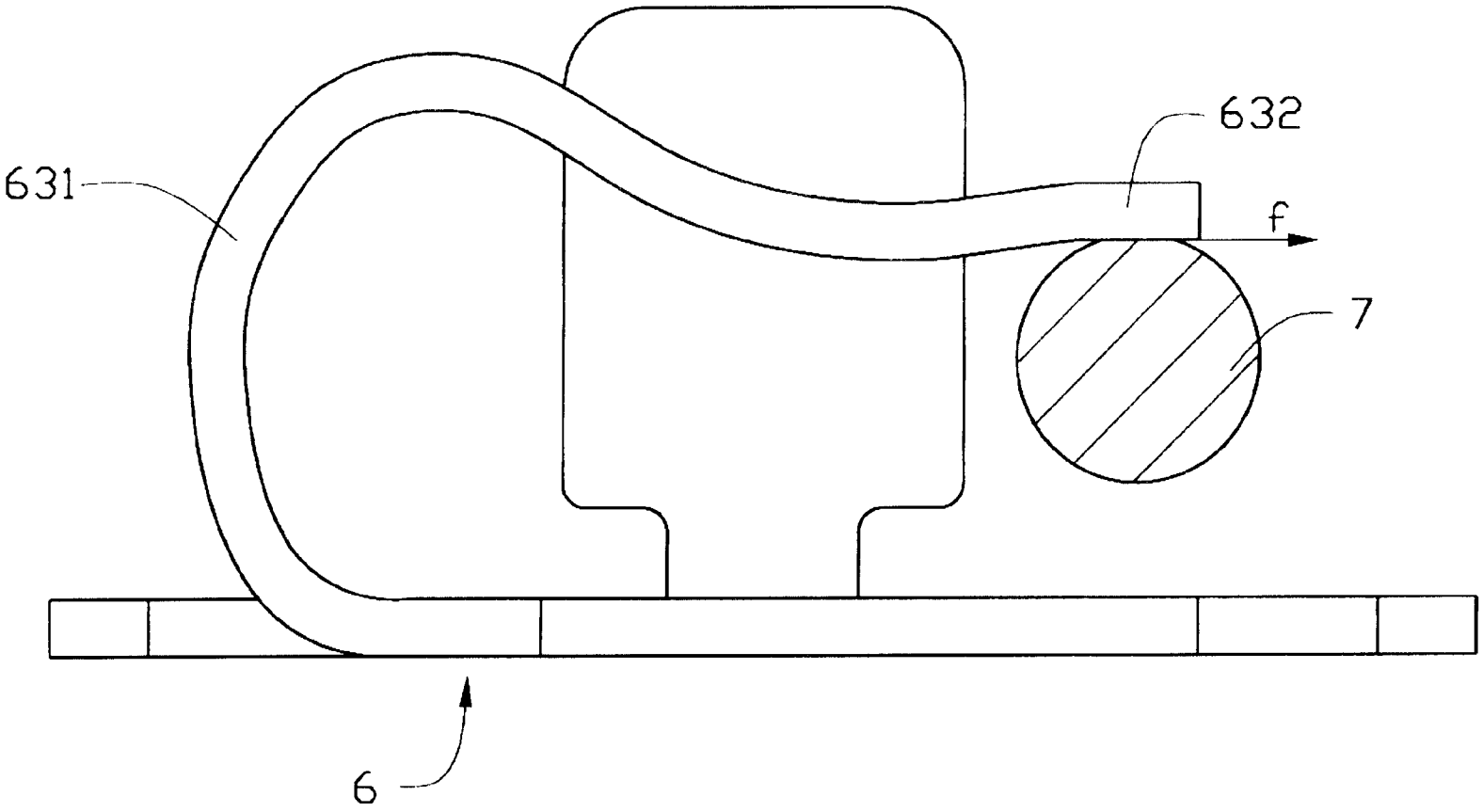
FIG. 2 (PRIOR ART)
FIG. 2 is a top, planar view of FIG. 1 showing the pin engaging with the contact.
Figure 3:
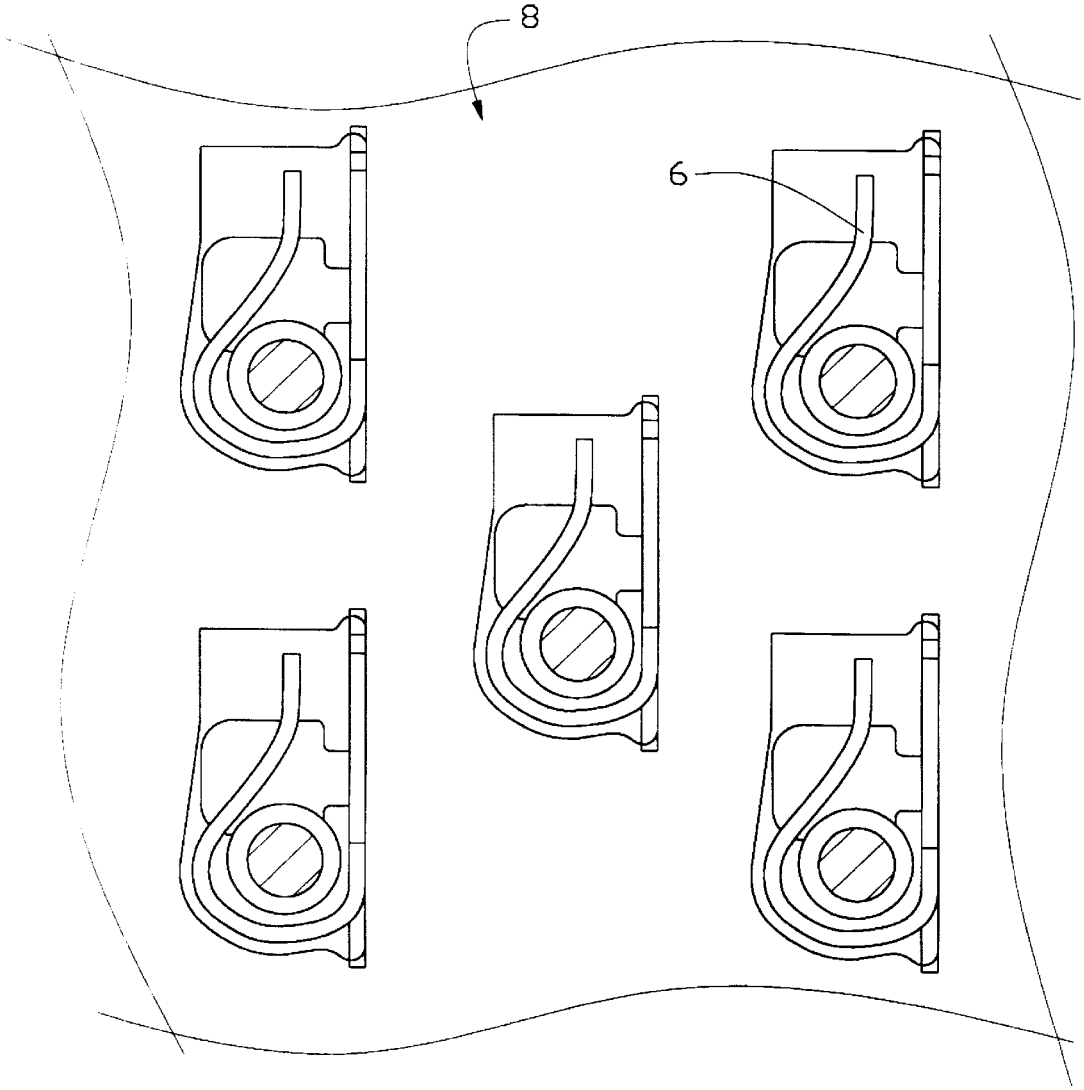
FIG. 3 (PRIOR ART)
FIG. 3 is a top, planar view of the conventional contacts received in a housing.
Figure 4:
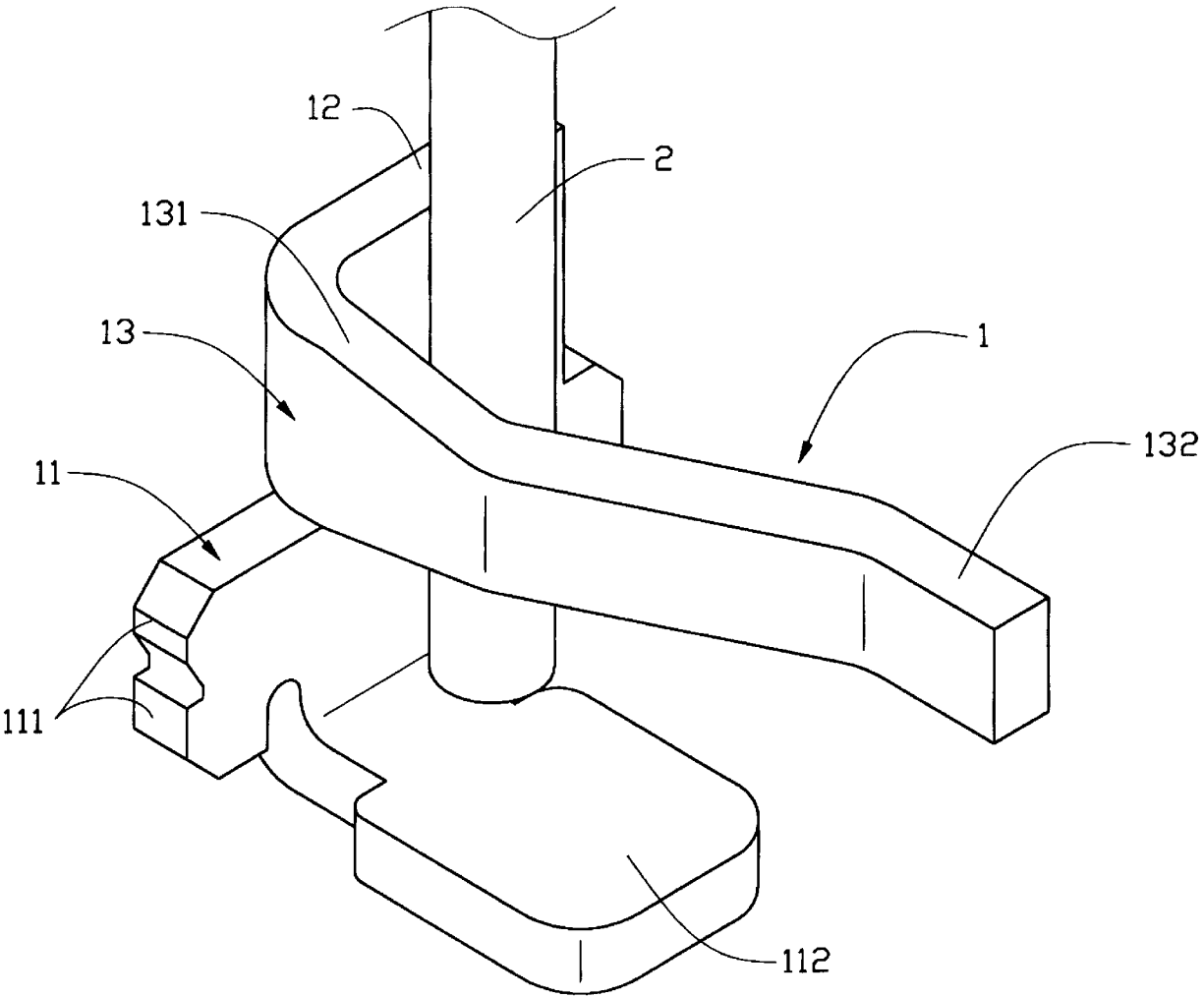
FIG. 4 is a perspective view of a contact for a ZIF socket embody portioning the concepts of the present invention.

Referring to FIG. 4, a contact 1 for use with a ZIF socket in accordance with the present invention comprises a base portion 11, a connecting portion 12 extending from a central portion of the base portion 11, and a body portion 13 extending from the connecting portion 12. The base portion 11 defines a pair of fixing protrusions 111 on opposite edges thereof for interferentially engaging with a housing 3 (see FIG. 6). A solder pad 112 extends from a bottom edge of the base 11 for electrically connecting with a printed circuit board (not shown).

The body portion 13 includes a receiving portion 131 extending from one side of the connecting portion 12 and a mating portion 132 extending from the receiving portion 131. The receiving portion 131 is slightly bent for receiving a pin 2 of a chipset in a first position. The mating portion 132 is perpendicular to the connecting portion 12 for sidewardly gripping the pin 2 of the chipset when the pin 2 is moved from the first position to a second position. Thus, an interferential direction between the fixing protrusions 111 and the housing 3 is substantially perpendicular to a movement direction of the pin 2 from the first portion to the second portion.

Figure 5B:
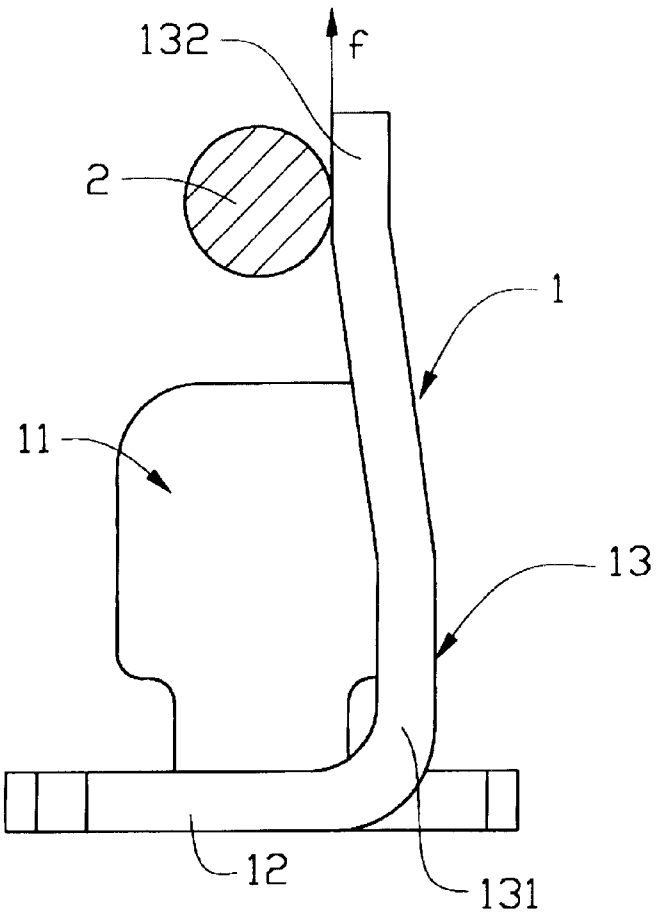
FIG. 5B is similar to FIG. 5A showing the pin engaged with the contact.
Figure 5A:
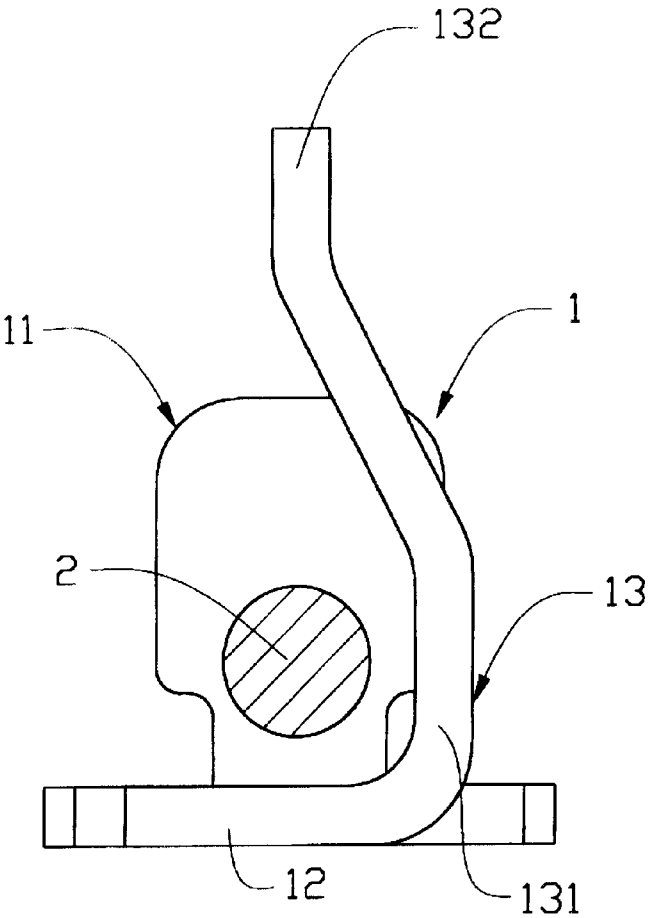
FIG. 5A is a top, planar view of FIG. 4 showing a pin of a chipset received in a receiving portion of the contact.

Referring to FIGS. 5A and 5B, when assembling the chipset to the ZIF socket, the pin 2 of the chipset is first received in the receiving portion 131 in the first position, and is then moved to sidewardly grip the mating portion 132 in the second position. When the pin is moved from the first position to the second position, a force f caused by reactive movement of the pin 2 is exerted on the contact 1 substantially at the center of mass thereof. Thus, only a negligible moment is incurred.

Figure 6:
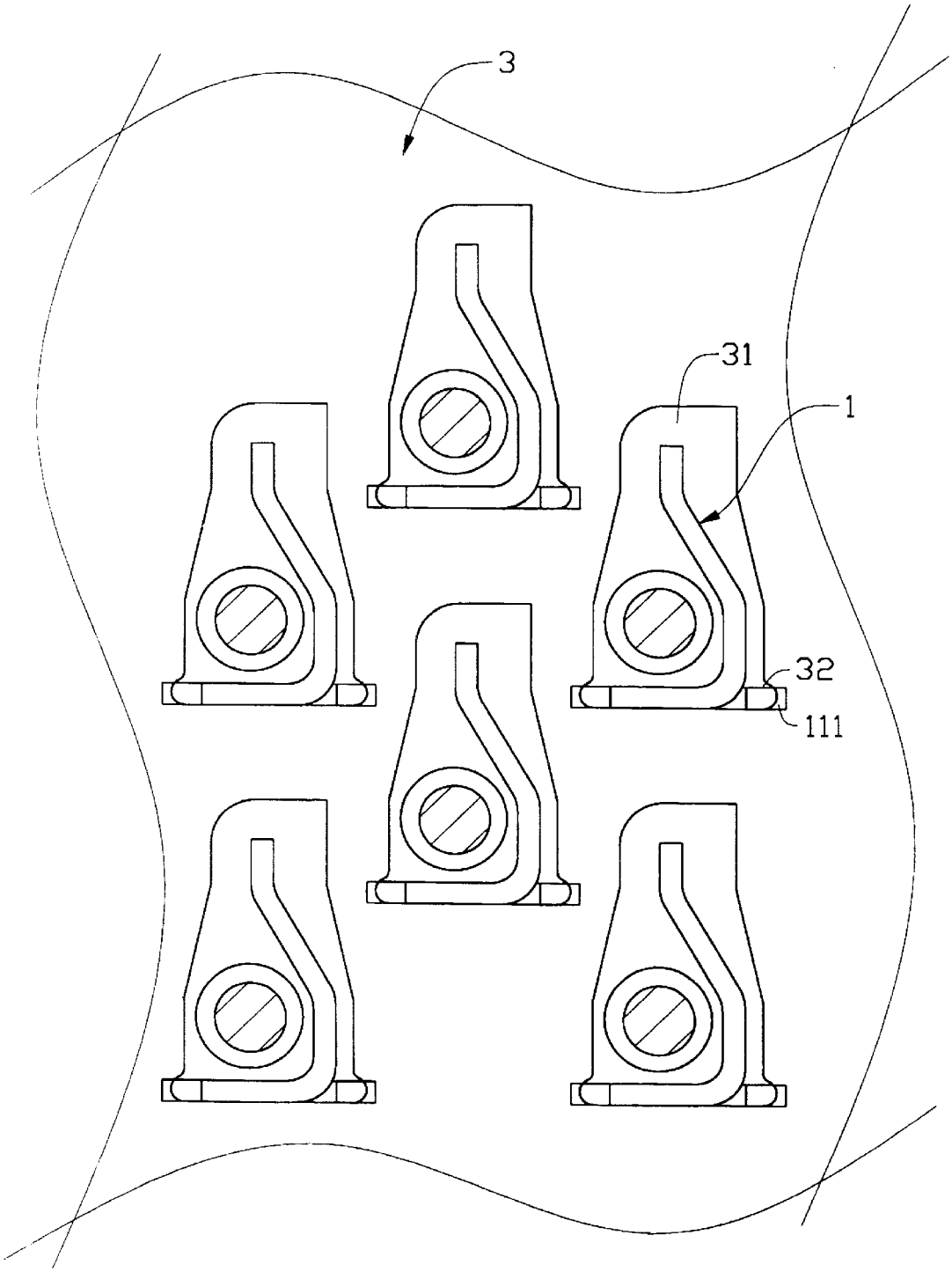
FIG. 6 is a top, planar view of the contacts of the present invention received in a housing.

Referring to FIG. 6, the ZIF socket includes the housing 3 and the contacts 1 received in the housing 3. the housing 3 forms a plurality of cavities 31 each of which forms a fixing recess 32 in an end thereof for interferentially receiving the fixing protrusions 111 of the contact 1. The fixing recesses 32 of adjacent cavities 31 are not aligned. Thus, the interferential engagement force between the contacts 1 of adjacent rows and the housing does not lie in plane whereby deformation of the housing 3 is minimized after insertion of the contacts 1.

The spirit of the invention is to provide a housing defining an array of cavities 31 with the adjacent cavities 31 of the adjacent two rows being arranged in a diagonal direction and thus being offset from or not aligned with each other wherein the retention section, i.e., fixing protrusions 111 extend in an interferential direction perpendicular to the row direction defined by each row. Because of being offset from each other for the proximate cavities 31 of the two adjacent rows, the accumulated deformation of the housing due to interferential retention of the fixing protrusions 11 with the housing along the interferential direction may be reduced to only one half amount comparatively.

It will be understood that the present invention may be embodied in other specific forms without departing from the spirit of the central characteristics thereof. The present example and embodiment, therefore, is to be considered in all respects as illustrative and not restrictive, and the invention is not to be limited to the details given herein.

What is claimed is:

1. A ZIF socket for electrically connecting a plurality of pins of a chipset to a printed circuit board, comprising:

a housing defining an array of elongated cavities; and a plurality of contacts being received in the cavities, respectively, each contact comprising;

a body portion including a receiving portion adapted for receiving a pin of the plurality of pins of the chipset which is positioned in a first position, and a mating portion extending from the receiving portion for sidewardly gripping the pin of the chipset which is positioned in a second position, a base portion having fixing protrusions on opposite edges thereof for securing to the housing, the fixing protrusions having interferential retention with the housing at two points, a line connecting the two points defining an interferential direction said interferential direction being substantially perpendicular to a moving direction of the pin from the first portion to the second portion, and a connecting portion connected between the base portion and the body portion.

2. The ZIF socket as described in claim 1, wherein the base portion is substantially perpendicular to the moving direction of the pin from the first portion to the second portion.

3. The ZIF socket as described in claim 1, wherein the receiving portion of the body portion is slightly bent.

* * * * *